United States Patent [19]

Preston

[11] 4,171,773

[45] Oct. 23, 1979

[54] FIRE JET AIR DISPLACEMENT HEAT EXCHANGER DEVICE

[76] Inventor: James N. Preston, 1633 W. Campbell, Phoenix, Ariz. 85015

[21] Appl. No.: 836,655

[22] Filed: Sep. 26, 1977

[51] Int. Cl.[2] ..... F24B 7/00

[52] U.S. Cl. ..... 237/55; 165/DIG. 2; 126/110 AA

[58] Field of Search ..... 126/110 AA, 110 E, 117, 126/121; 165/40, DIG. 2; 236/78 B, 78 D, DIG. 9, 11; 237/54, 55

[56] References Cited

U.S. PATENT DOCUMENTS

| | | | |
|---|---|---|---|
| 2,243,503 | 5/1941 | Frenette | 237/55 |
| 2,348,834 | 5/1944 | Mueller | 237/55 |

FOREIGN PATENT DOCUMENTS

| | | | |
|---|---|---|---|
| 1095644 | 12/1967 | United Kingdom | 126/121 |

OTHER PUBLICATIONS

"The Chimney Furnace" Brochure, Plate No. 1378.

*Primary Examiner*—Carroll B. Dority, Jr.
*Assistant Examiner*—Lee E. Barrett

[57] ABSTRACT

The invention is comprised of a heat exchanger around the exhaust stack of any combustible fuel-burning system and also around the outside of any fuel-burning device; each heat exchanger filled with a porous heat-conducting material so that fresh outside air pulled by motor-powered means into any building operates to replace the cold air therein with fresh warm air preheated from the combustion device and stack.

2 Claims, 3 Drawing Figures

1
2
3
4
5
6
7
8
9
10
11
12
13
14
15
16
17
18
19
20
21
22
A
B

FIRE JET AIR DISPLACEMENT HEAT EXCHANGER DEVICE

The object of the invention set forth in the following specification is to provide means to make use of wasted heat energy that usually goes up the exhaust stack of any combustible fuel-consuming device with the aid of a motor-powered air circulation system so that the air that the fuel-burning system pulls into any building or housing structure is no longer cold air and so that the cold air inside any such building or housing structure is consumed by the process of combustion and replaced with warm air from the outside atmosphere, made warm by the heat exchanger.

Referring to the drawing, FIG. 1 shows a cutaway view or partial cross-section of the exhaust stack heat exchanger located atop the transition leading from any fuel-consuming device as viewed along lines 1—1 of FIG. 2.

Figures 1, 2, 3:
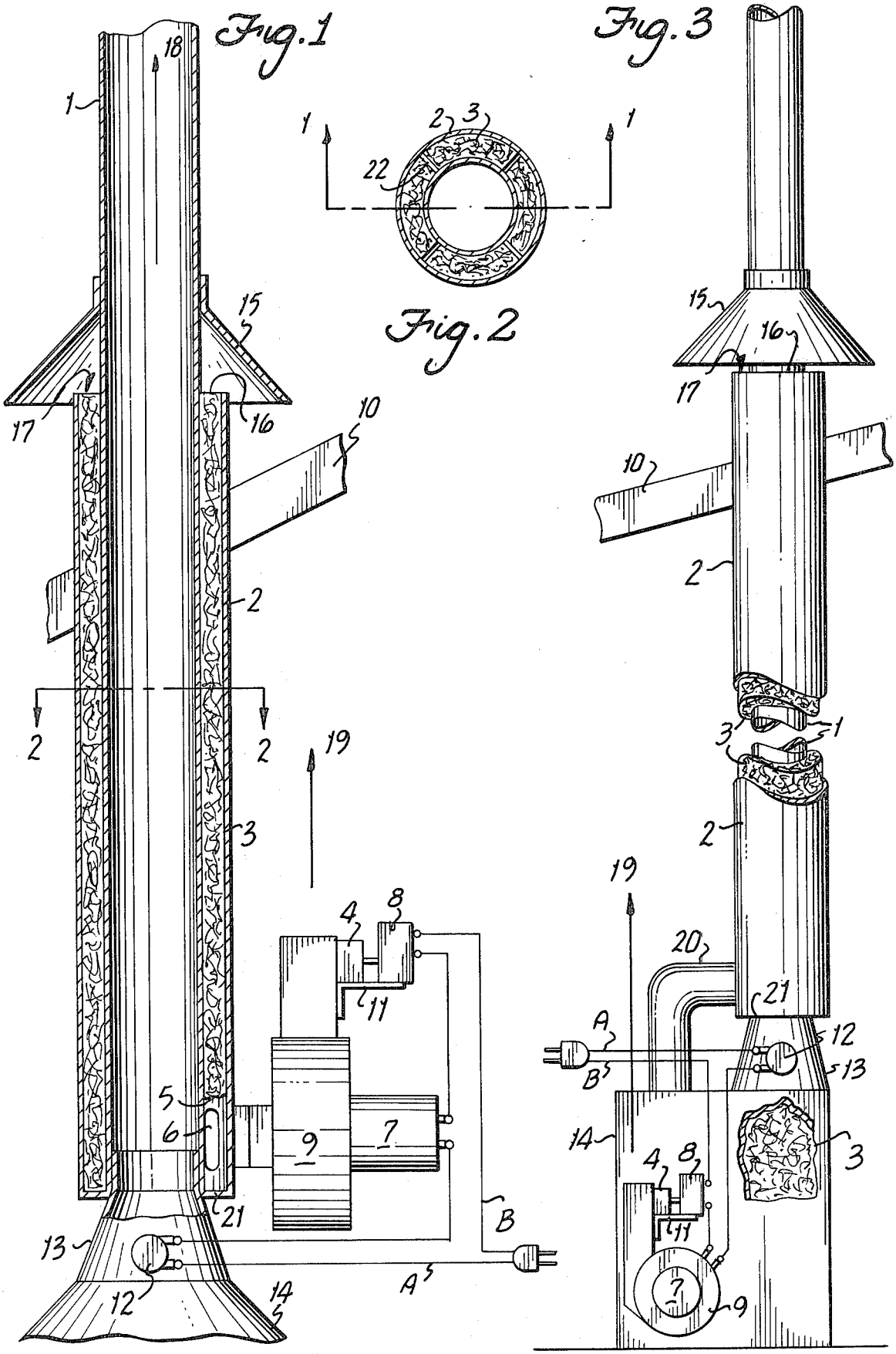
FIG. 2 shows a cross-section view of the exhaust stack and heat exchanger of FIG. 1 as viewed along lines 2—2 of FIG. 1.
FIG. 3 is a cut-away view of the exhaust stack heat exchanger that is connected so as to conduct air from the intake port into the heat exchanger of the fuel-consuming heater and thence into the interior of the building.

Referring to the drawing in more detail, the numeral 1 represents the exhaust stack that leads from the transition conduit 13 and any fuel-consuming device represented by the numberal 14. The exhaust stack 1 operates to conduct exhaust gas from the fuel-consuming heating apparatus 14 in the vertical direction and through the roof 10 of any housing structure. The exhaust stack 1 is made leak-proof so that exhaust gases do not leak into the interior of the building or into the heat exchanger material 3 within the outer conduit 2 which surrounds the exhaust stack 1. The air gap between the outer conduit 2 and the exhaust stack 1 is filled with a heat conducting material 3, such is lightweight small spheres of aluminum foil or porous steel wood which is in connection with the outside surface of the exhaust stack 1 and allows air to flow downward into the building interior through air intake port 16 into the motorized blower 9 via port and screens 5 which operate to keep the port 6 free of the porous heat conducting material 3 in the exhaust port heat exchanger. The electric motor 7 activates the air blower 9 to pull the outside atmospheric air downward through the exhaust stack heat exchanger which gains heat from the porous heat conducting material 3 and the warm air is exhausted upward in the direction 19 from the blower 9. The rain cover 15 protects the top of the exhaust stack heat exchanger and thereby operates to prevent rain from entering the intake port 16 of the outer conduit 2 while air from the air flows in the direction 17. Combustion gases from the heating means 14 rise upward through the exhaust stack 1 in the direction 18.

Attached to the exhaust transition conduit 13 is the ordinary type of on-off thermostat electric switch 12 which operates to electrically connect electrical current from electric circuit A to the electric motor whenever a fire in the fuel-consuming device 14 heats the thermostat above a predetermined minimum temperature. Fastened to the exhaust of the air blower 9 by braces 11, the rotary-type thermostat 4 operates to sense the temperature of the air from the blower 9. When the air exhausting from the blower 9 in the direction 19 into the building interior is only slightly warm, the rotary thermostat 4 operates to keep the electric lamp dimmer-type of rheostat 8 turned to a minimum degree of electrical conductivity through its rotary resistor switch. At minimum setting, the rheostat 8 operates to electrically conduct electricity through the electric blower motor to circuit wire B so that the electric motor operates at idle speed and pulls only a minimum amount of air from the exhaust stack heat exchanger into the room interior. Only the electric thermostat switch 12 operates to turn the motor 7 on and off. When the exhaust air from the heater device 14 operates to heat the intake air in the heat exchanger outer conduit 2 to a higher temperature, the thermstat 4 operates to sense the increase in air temperature emitting through the blower and increases the speed of the electric blower motor through rheostat 8 by turning the rotary switch on said rheostat 8 to increase the amount of electricity flowing through the electric motor 7 via wires A, B which are connected to any industrial or household current outlet. The exhaust stack 1 extends above the height of the outer conduit and roof for a sufficient distance to prevent the exhaust gases from settling into the inlet 16 of the outer conduit 2.

The second version of the invention is shown in FIG. 3 of the drawing where the heated air from the heat exchange gap between the exhaust stack 1 and the outer conduit 2 is conducted from port 6 via conduit 20 into the heat exchange chamber that many fuel-consuming furnaces are provided with. Such a furnace or fireplace type of fuel-consuming device is represented by the numeral 14 in FIG. 3 of the drawing. The cutaway view of the furnace 14 outer jacket wall shows the porous heat-conducting and air conducting material 3 located between the inner wall and the outer wall of the furnace 14 to increase the efficiency of the invention. The operation of the second version of the invention is identical to that of the first version except that the motor-driven blower 9 operates to pull hot air from the heat-exchanger of the furnace after is has travelled downward from the atmosphere through inlet 16, port 6 and through conduit 20 into the heat exchange jacket of the furnace 14, providing an increase of heated heat-conducting material 3 therein in contact with the air which is exhausted upward in the direction 19 from the motor-driven blower 9. The bottom of the heat exchanger is sealed by circular wall 21.

The invention operates to automatically turn itself on each time that a fire is ignited in any fireplace, furnace, or other fuel-consuming device and activates thermostat electric switch 12 which automatically operates to turn itself off each time that the fire goes out, decreasing the temperature of transition conduit 13. The device also operates to eliminate the problem of some housing structures that sometimes tend to draw smoke from its fireplace into the building when the doors and windows on the upwind side of the building are well-sealed and those on the down-wind side are not so well-sealed so that they cause a vacuum in the building from the action of the wind. Each time that waste heat goes up the exhaust stack 1 of the device, the electric motor-powered blower 9 operates to create a slightly-high pressure area within the building when it forces warm air from the heat exchangers into the building from the outside atmosphere. This operates to increase the efficiency of the burning of the combustible fuel in the furnace 14 and also to increase the level of smoke-free air in the building.

The air gap between exhaust stack 1 and conduit 2 is maintained by spacers 22.

Having thus described the invention, the following is claimed:

1. A heat exchanger device comprising; an exhaust stack connected to a fuel-consuming device, and an outer conduit about said stack; an air gap between said stack and said conduit containing with a good heat-conducting material that comes in contact with the outer surface of the exhaust stack to conduct waste heat therefrom and being of sufficient porosity to allow outside air to flow downward through it into the inside of any building; the exhaust stack rising higher than the outer conduit; air from the lower end of said air gap being channelled into the top of a heat exchanger air jacket around the fuel-burning device by conduit means; the air jacket of the fuel-burning device device being likewise filled with said heat-conducting material to increase the heat flow from the fuel-burning device into the air flow; an electric motor-powered air blower operating to move heated air from the heat exchange air jacket of the fuel-burning device and exhaust the heated air into the inside of the building; the electric motor being energized from any source through two thermostatically-controlled electric switches wired in series circuit with the electric motor; one of said switches being fastened in contact with the exhaust stack of the fuel-burning device operating to energize the electric motor each time that the fuel-burning device exceeds a predetermined temperature and to deenergize said motor each time that the fuel burning device falls below said predetermined temperature; the other thermostatically-controlled electric switch in series circuit including means located in the exhaust stream of air from the blower to operate the motor at idle speed when cool and to increase the motor speed as the temperature of the exhaust air increases; the blower operating to move outside air from the atmosphere down through the air gap and furnace heat exchanger air jacket to provide the building with air heated by waste heat with great efficiency.

2. A heat exchanger device comprising; an outer conduit around an exhaust stack that leads from a fuel-consuming and heating device, such as a fireplace, furnace, stove, etc.; an air gap between the exhaust stack and the outer conduit containing a porous heat-conducting material that is in contact with the outside of the exhaust stack to conduct waste heat therefrom and being of sufficient porosity to allow air from the atmosphere to flow down through the material into the inside of any building; the exhaust stack extending higher than does the outer conduit; a flange or wall extending outward from the exhaust stack to seal the lower end of the air gap of the heat exchanger device; an electric motor-powered air blower connected to the lower end of said air gap operating to move outside air from the atmosphere down through the porous heatconducting material therein and to then move the heated air from the heat exchanger into the confines of the building; the electric motor of the blower connected to any source of electrical current and in series circuit with a thermostatically-controlled electric switch that automatically switches on each time that the fuel burning device reaches and exceeds a predetermined temperature and off each time the fuel-burning device falls below that temperature; the series circuit also including a thermostatically-controlled means to operate the electric motor at variable speeds ranging from idle speed to full speed and located in the exhaust stream from the blower so that warm air operates to cause said means to speed up the motor and cool air causes said means to slow down the motor.

* * * * *